United States Patent [19]

Cerulla

[11] Patent Number: 4,986,546

[45] Date of Patent: Jan. 22, 1991

[54] HORSE RACING BOARD GAME

[76] Inventor: Frederick A. Cerulla, 2135 Tenth St. S., Wyandotte, Mich. 48192

[21] Appl. No.: 484,994

[22] Filed: Feb. 26, 1990

[51] Int. Cl.[5] ..... A63F 3/00

[52] U.S. Cl. ..... 273/240; 273/246; 273/282

[58] Field of Search ..... 273/246, 240, 282 R, 273/282

[56] References Cited

U.S. PATENT DOCUMENTS

| | | | |
|---|---|---|---|
| 1,628,073 | 5/1927 | Sousa | 273/246 |
| 3,560,127 | 2/1971 | Imperato | 273/246 |
| 4,025,075 | 5/1977 | Priska et al. | 273/282 R |
| 4,884,816 | 12/1989 | Ford et al. | 273/240 |

FOREIGN PATENT DOCUMENTS

| | | | |
|---|---|---|---|
| 373807 | 3/1907 | France | 273/246 |
| 319906 | 10/1929 | United Kingdom | 273/246 |
| 572462 | 10/1945 | United Kingdom | 273/246 |
| 841727 | 7/1960 | United Kingdom | 273/246 |

*Primary Examiner*—Benjamin Layno

*Attorney, Agent, or Firm*—Leon Gilden

[57] ABSTRACT

An apparatus includes a pivotally mounted planar board, including a series of aligned six racing tracks, wherein the tracks are oriented for six individual racers, or players, to direct their tokens upwardly, the rearwardly, and then directed over the track for a third time to cross an associated finish line. Wagering is effected by individual players deciding upon the betting odds to be given to each horse and predetermined amounts to wager on selected horses or players, with associated tokens and playoffs resulting therefrom. The apparatus includes lap indicator members for securement at the forward end of an upper game board portion to indicate when an individual player has completed a single lap to indicate that player has two additional laps to complete. Three dice are utilized, with two dice indicating two of the six players to advance, with a third die of a contrasting coloration indicating a predetermined number of spaces to be moved by those players. A blackboard is provided for writing down the betting odds of each horse and for indicating the wagering awarded to each horse.

1 Claim, 4 Drawing Sheets

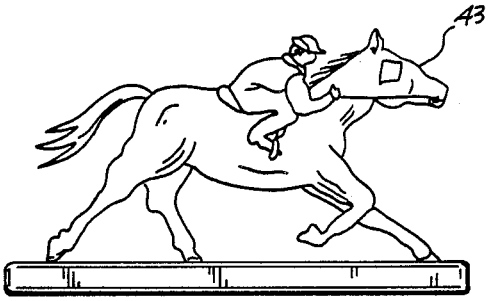
FIG 2
FIG 3
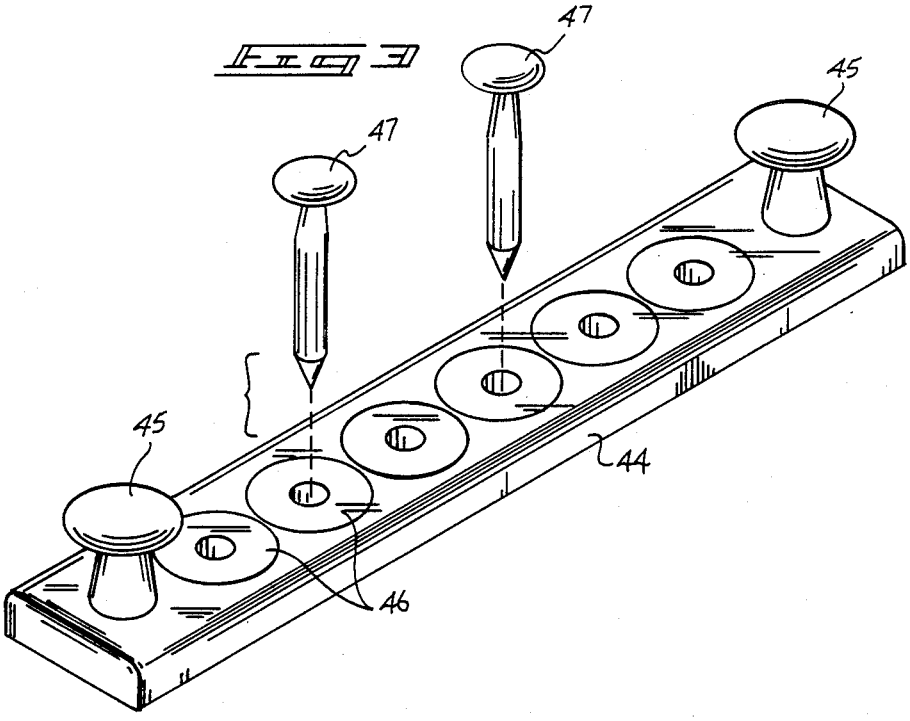

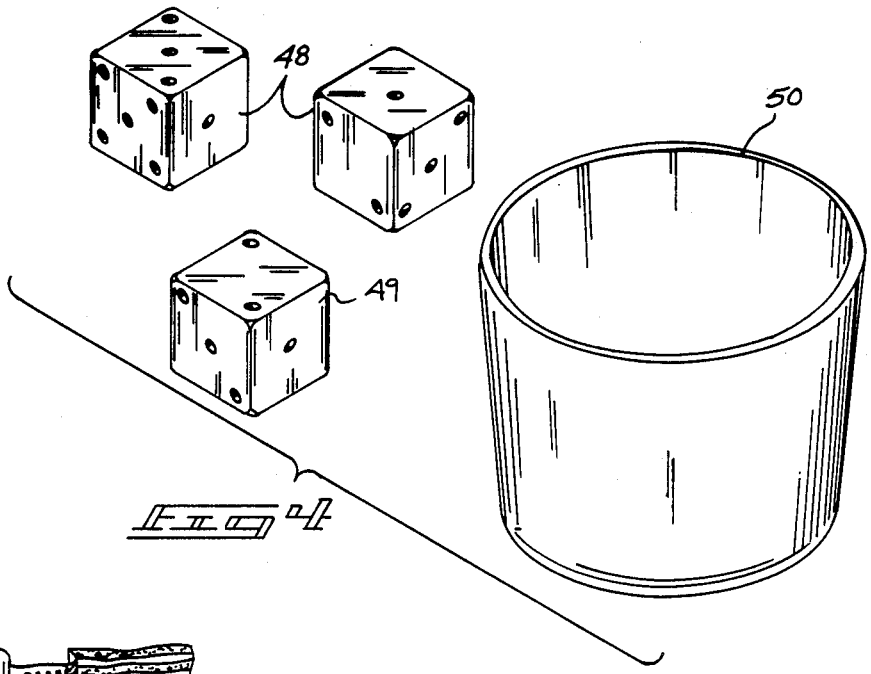
FIG 4
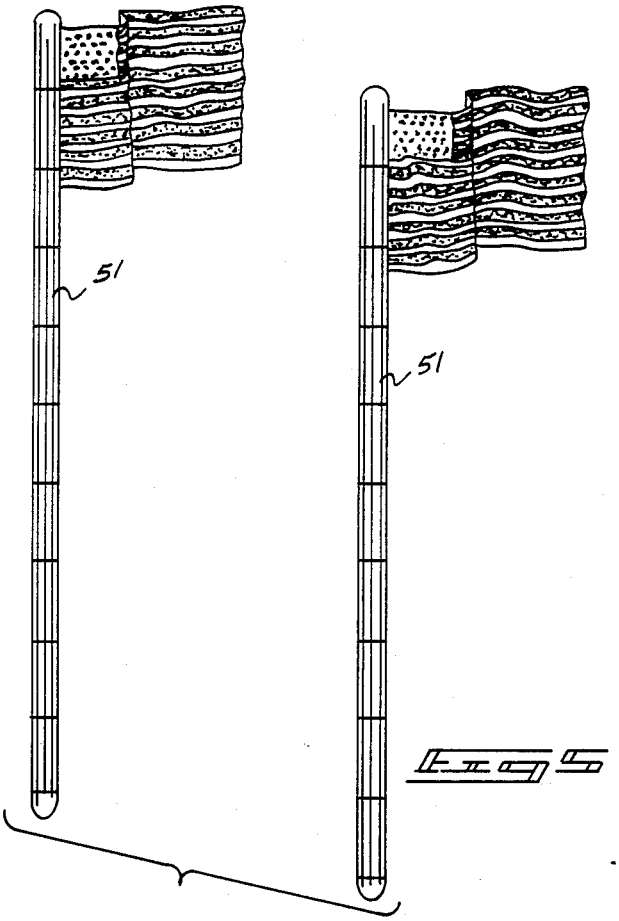
FIG 5
FIG 6
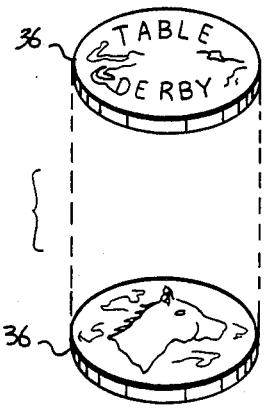

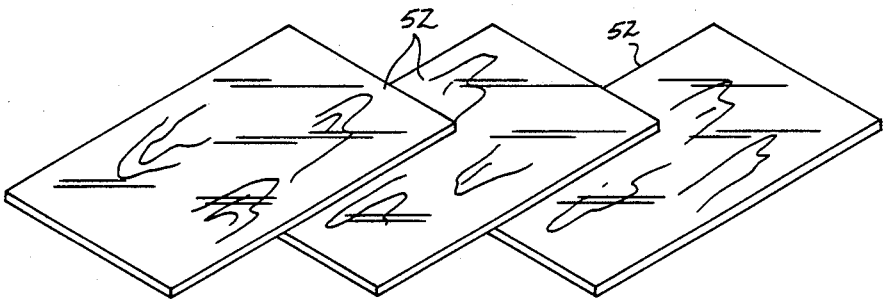
FIG 7
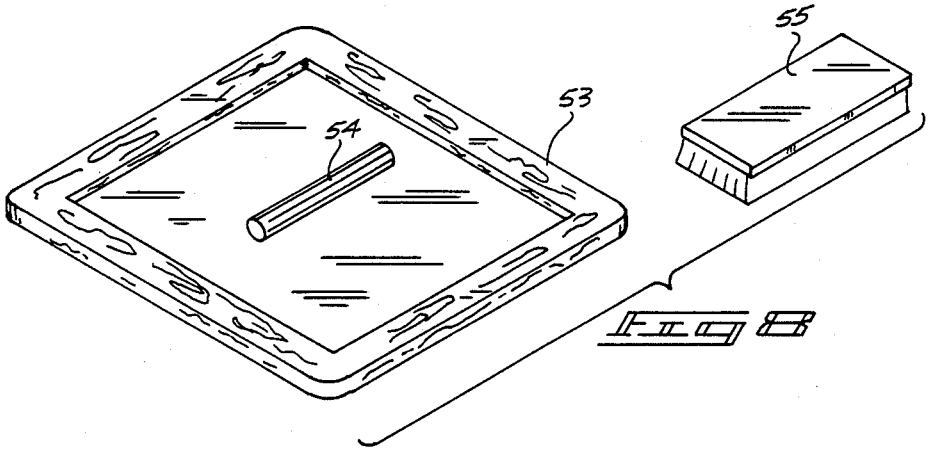
FIG 8
FIG 9
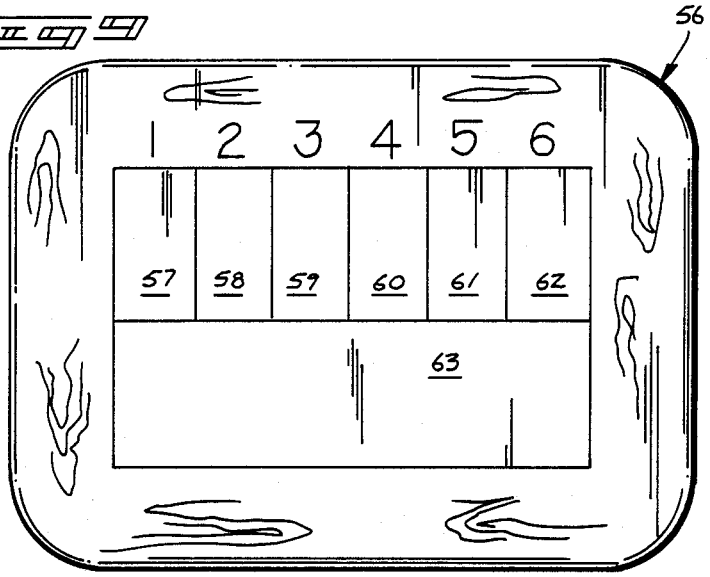

HORSE RACING BOARD GAME

BACKGROUND OF THE INVENTION

1. Field of the Invention

The field of invention relates to board games, and more particularly pertains to a new and improved horse racing board game wherein the same effects simulation of a horse racing event to provide entertainment in the playing and wagering associated with such events.

2. Description of the Prior Art

Board game apparatus for various applications has been utilized throughout the prior art. Further, it is known that prior horse racing apparatus in board game application has been presented in the prior art.

Heretofore, however, the horse racing apparatus of the prior art has failed to provide a compact, portable horse racing track arrangement utilizing a two-part board game for securement of and storage of the board game during periods of non-use. Examples of the prior atrt include U.S. Pat. No. 4,368,889 to Reker illustrative of a typical board game organization providing a perimeter path about a central, planar board surface.

U.S. Pat. No. 4,057,254 to Girres is illustrative of a planar horse racing playing surface organization providing an oval shaped path of travel for a plurality of players utilizing a die for indicating movement of the tokens.

U.S. Pat. No. 4,729,568 to Welsh sets forth a horse race board game formed upon a planar playing surface defining a generally rectangular matrix of spaces utilizing a plurality of die and cards for movement of the token pieces about the game board.

U.S. Pat. No. 4,264,076 to Duncan is illustrative of a board racing game apparatus wherein various representative automotive tokens are directed about an oval path of travel.

U.S. Pat. No. 4,042,245 to Zarour is a further example of a board game utilizing an oval shaped path of travel including six die associated therewith rolled in a central zone for indication of movement of various tokens about the surface of the board.

U.S. Pat. No. 3,690,666 to Seitz is illustrative of another horse racing game apparatus provided by an oval shaped path of travel, as is typical of the prior art.

As such, it may be appreciated that there is a continuing need for a new and improved horse racing board game apparatus wherein the same addresses both the problems of ease of use and effectiveness in the storage and transport of the game during periods of non-use, and in this respect, the present invention substantially fulfills this need.

SUMMARY OF THE INVENTION

In view of the foregoing disadvantages inherent in the known types of board game apparatus now present in the prior art, the present invention provides a horse racing board game apparatus wherein the same provides for a plurality of board surfaces hingedly mounted relative to one another to enable compact storage and transport of the organization during periods on non-use, as well as providing linear paths of travel for the various tokens utilized in contradistinction to typical oval shaped paths of travel utilized by the prior art. As such, the general purpose of the present invention, which will be described subsequently in greater detail, is to provide a new and improved horse racing board game apparatus which has all the advantages of the prior art board games and none of the disadvantages.

To attain this, the present invention provides an apparatus including a pivotally mounted planar board, including a series of aligned six racing tracks, wherein the tracks are oriented for six individual racers, or players, to direct their tokens upwardly, then rearwardly, and then directed over the track for a third time to cross an associated finish line. Wagering is effected by individual players deciding upon predetermined amounts to wager on selected horses or players, with associated tokens and payoffs resulting therefrom. The apparatus includes lap indicator members for securement at the forward end of an upper game board portion to indicate when an individual player has completed a single lap to indicate that player has two addtional laps to complete. Three dice are utilized, with two dice indicating two of the six players to advance, with a third die of a contrasting coloration indicating a predetermined number of spaces to be moved by those players.

My invention resides not in any one of these features per se, but rather in the particular combinatin of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved horse racing board game apparatus which has all the advantages of the prior art board games and none of the disadvantages.

It is another object of the present invention to provide a new and improved horse racing board game apparatus which may be easily and efficiently manufactured and marketed.

It is a further object of the present invention to provide a new and improved horse racing board game apparatus which is of a durable and reliable construction.

An even further object of the present invention is to provide a new and improved horse racing board game apparatus which is susceptible of a low cost of manufacture with regard to both materials and labor, and which accordingly is then susceptible of low prices of sale to the consuming public, thereby making such horse racing board game apparatus economically available to the buying public.

Still yet another object of the present invention is to provide a new and improved horse racing board game apparatus which provides in the apparatuses and methods of the prior art some of the advantages thereof, while simultaneously overcoming some of the disadvantages normally associated therewith.

Still another object of the present invention is to provide a new and improved horse racing board game apparatus wherein the same addresses both the problems of convenience and ease of use in simulating various aspects of horse racing, as well as enabling compact storage and transport of the organization during periods of non-use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an orthographic side view taken in elevation of a representative token utilized by the instant invention.

FIG. 3 is an isometric illustration of the support bar and its mounting of the various lap indicator markers utilized by the instant invention.

FIG. 4 is an isometric illustration of the three dice, including two white and one contrasting colored die, utilized by the instant invention.

FIG. 5 is an orthographic view taken in elevation of the plural finish line flag as utilized by the instant invention.

FIG. 6 is an isometric illustration of the betting tokens utilized by the instant invention.

FIG. 7 is an isometric illustration of the color coded cards awarded each bettor in the play of the instant invention.

FIG. 8 is an isometric illustration of the individual chalk board sets provided each player.

FIG. 9 is a top orthographic view of the game blackboard utilized by the instant invention.

DESCRIPTION OF THE PREFERRED EMBODIMENT

Figure 1:
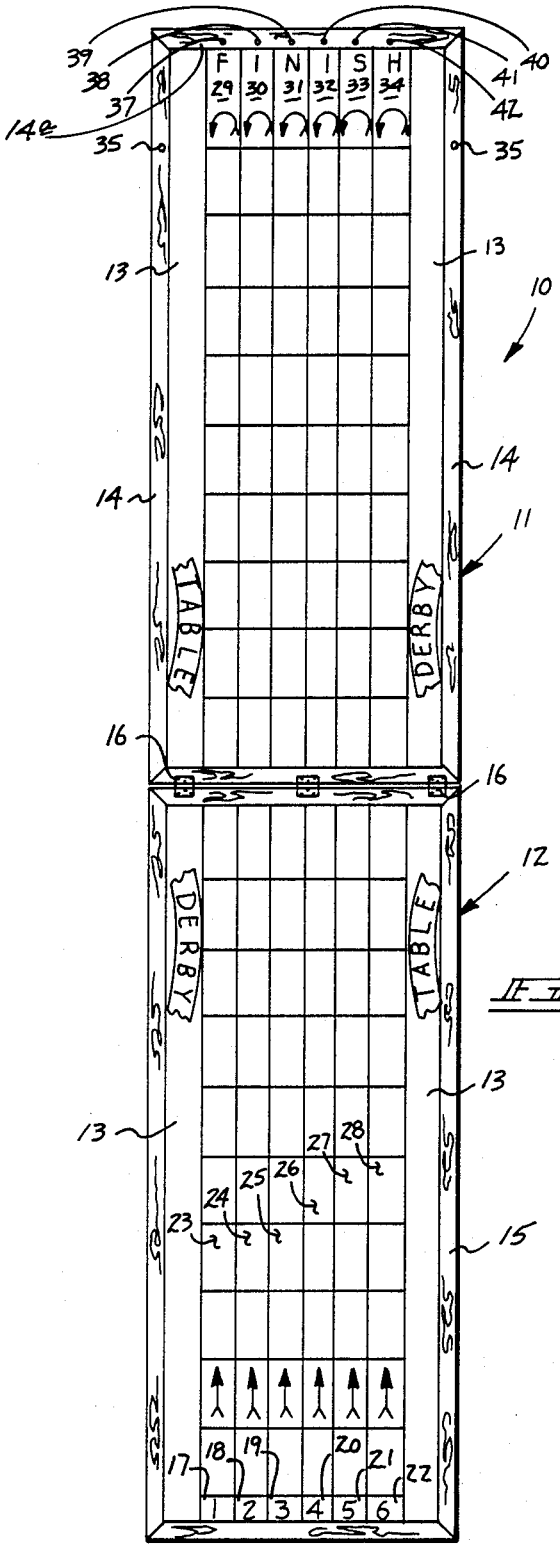
FIG. 1 is a top orthographic view of a playing board of the instant invention.

With reference now to the drawings, and in particular to FIGS. 1 to 9 thereof, a new and improved horse racing board game apparatus embodying the principles and concepts of the present invention and generally designated by the reference numeral 10 will be described.

FIG. 1 is illustrative of the board game playing surface 10 defined by a first elongate rigid game board 11 hingedly mounted at its lowermost end to an upper end of a second elongate game board 12. A hinge series 16 pivotally mounts the game boards together to enable their collapse for transport and storage of the game board.

The game board is defined by elongate left and right side borders 13 for simulation of a race track infield, wherein the first game board 11 includes a first game board perimeter edge 14 and an upper end edge **14*a* with the second game board 12 utilizing a second game board perimeter edge 15** extending in surrounding relationship to the second game board.

Mounted in a linear relationship adjacent the lowermost edge of the second game board are a series of starting positions defined as a first starting position 17, a second starting position 18, a third starting position 19, a fourth starting position 20, a fifth starting position 21, and a sixth starting position 22, each of a respective first, second, third, fourth, fifth, and sixth coloration. The starting positions are arranged in a sequential order between the elongate side borders 13 of the second game board 12 and arranged generally orthogonally relative to the longitudinal axis defined by the first and second game board 11 and 12. Arranged parallel to the longitudinal axis of the first and second game boards are a series of linear tracks, each aligned adjacent to and parallel relative to one another and originating with a respective starting position, wherein the linear tracks are defined by nineteen spaces, with ten spaces in the second game board and nine additional spaces aligned with the first ten spaces of each linear track in the first game board. The linear tracks are defined by a respective first, second, third, fourth, fifth, and sixth linear track 23, 24, 25, 26, 27, and 28 respectively. Each linear track includes at least one directional arrow positioned in a space proximate the starting positions to indicate an initial direction of travel by each player token positioned within each starting position. Each linear track terminates with a turn and finish square mounted adjacent the upper end edge **14*a* and aligned therewith, wherein the turn and finish squares 29, 30, 31, 32, 33, and 34 are each aligned with and parallel to each associated linear track and define a first, second, third, fourth, fifth, and sixth turn and finish square respectively. Each turn and finish square includes a turn indicator arrow. The turn indicator arrow is indicative of a redirectional orientation of each token as it completes its first lap, or the first nineteen squares, whereupon each token must turn and traverse each associated linear track back towards the starting position, whereupon the individual tokens will again turn for a third traverse of each linear track to terminate in the associated turn and finish square. Aligned with and adjacent a demarcation indicia indicating division between the last linear track square adjacent the turn and finish square is a flag pole receiving bore 35 mounted within each right and left side of the first game board perimeter edge. The flag pole receiving bores 35 receive each a respective flag member 51, including an associated post formed with a pointed lowermost end to be directed within each flag pole receiving bore 35. Formed orthogonally through the upper end edge 14*a* are a series of lap marker bores 37, 38, 39, 40, 41, and 42 for designation of a respective first, second, third, fourth, fifth, and sixth lap marker. The lap marker bores 37–42 are arranged each respectively in alignment with an associated turn and finish square 29–34. Upon completion of an initial lap or linear track sequence by each respective token, a representative lap marker 47 is mounted therewithin. Each lap marker 47 is of a different coloration and is defined by the respective six colorations associated with each starting position and each token. A representative token 43 is illustrated in FIG. 2, wherein each token is also of a distinctive coloration associated with each player and with each starting position. A support bar 14 formed with orthogonally mounted handles to an upper support 45 mounted to opposed upper terminal ends of the support bar is provided with a series of aligned lap marker receiving bores 46 to receive each contrasting colored lap marker indicator 47 therewithin prior to its positioning within an associated marker bore 37–42**.

FIG. 4 is illustrative of the three dice utilized by the instant invention utilizing two dice 48 of a white coloration, wherein the two dice and the third contrasting colored dice 49 are spun from an associated dice cup 50, whereupon each player sequentially takes a turn in throwing the three dice, wherein the two white dice indicate which two player tokens will be advanced, i.e. two and six for example. The third dice 49 of a contrasting color indicates the number of spaces along the respective linear track occupied by each token that particular token will advance.

FIG. 6 is illustrative of a wagering chip utilized by players of the instant invention in the simulation of wagering effected by the players of the instant invention. The wagering tokens 36 of a predetermined number are awarded each player prior to the outset of the game.

Wagering tickets 52, each of a contrasting coloration in association with each first through sixth coloration consistent with the player tokens, starting positions, and lap markers are awarded to each individual wagering to assure that each individual player wagering in the playing of the game is in a non-confusing manner assured exactly which colored token that individual is betting upon. Accordingly, additional players in addition to those utilizing the tokens 43 are provided the opportunity to wager in the playing of the game. To this effect, each player is provided an individual chalk board organization, including an individual chalk board 53, and individual chalk member 54, and an individual eraser 55 for each player to decide upon which token to bet upon and the extent of the wager. It is understood that each player wagering may wager upon only a single token or "horse" to avoid confusion in the betting of the game outcome. FIG. 9 is illustrative of the game blackboard 56 provided with a series of player odds columns 57–62 defined by a respective first through sixth player odds column 57–62, wherein final odds, or the amount and leveraging ratio of each token players is inscribed to further avoid confusion in wagering during the playing of the game. An information space 63 is provided underlying the player odds columns 57–62 to provide information as to the winner, ultimate award of prizes, and the like. Should there be no wagering upon an individual token or "horse", that token is said to be "running free" and may certainly be calculated in the award or non-award of ultimate prizes in the playing of the game. Should there be no winner chosen by individual players, the purse is simply maintained and awarded to the ultimate winner of a subsequent race.

It is suggested that each player be awarded ten of the wagering chips or tokens 36 at the outset of the game, with the total number of players at liberty to bet limited to twelve such players for a total number of 120 chips 36. The players, upon placing their wagers, receive a color coded wagering ticket 52 to ensure their discrepancy as to which individual wagered on which token 43. One player or individual is selected to arbitrarily determine the odds of each token 43 in the token's traverse of an associated linear track, with a further player or "croupier" overseeing the player determining the odds of each token to ensure correction of such calculations. The wagering chips 36 are placed and wagered upon individual tokens and divided by the total number of wages placed upon individual horses or tokens 43. The winner of an individual race, i.e. the player with the correct betting position, is awarded all of the chip tokens 36.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A horse racing board game apparatus including an elongate game board including a first game board member and a second game board member, each first and second game board member longitudinally aligned relative to one another and of an equal configuration relative to one another, each first and second game board member hingedly mounted relative to one another at a lower end of the first game board member at an upper end of the second game board member, the game board including a series of six starting positions longitudinally aligned with a lowermost edge of the first game board member, and six linear tracks longitudinally aligned relative to each starting position, and wherein each linear track is aligned relative to one another in a parallel relationship, with each linear track terminating in a turn and a finish square, and each turn and finish square including a lap marker bore mounted within the first game board adjacent each turn and finish square for indication of a completion of a first traverse of each linear track from each respective starting position to each turn and finish square, and a series of six tokens of contrasting coloration positionable within each respective starting position, and each starting position of a like coloration relative to each token, and further including three dice, wherein two dice are of a first coloration and the third die is of a third coloration, wherein the first two dice indicate which of the variously colored tokens are to be positioned along each linear track, and the third die is formed with indicia to indicate a predetermined number of positions along each linear track to be traversed, and wherein each linear track includes ten spaces aligned in the second game board originating from each respective starting position, with nine additional spaces aligned with the ten spaces, wherein the nine spaces are aligned with the ten spaces, whereing the nine spaces are aligned in the first game board, and the turn and finish square is mounted and positioned within each terminal end of the nine respective spaces of each of the six linear tracks, and further including a flag marker bore mounted in alignment with the turn and finish squares and arranged to selectively receive a flag therewithin, wherein each flag includes an elongate rod with a flag at an upper end and a pointed lower end to be slidably received within each bore, and wherein each lap marker is initially mounted within an elongate support bar, the support bar including spaced channel members directed upwardly and orthogonally thereof for convenient transport of the support bar, the support bar includes six aligned support bar bores to receive the markers therewithin, and wherein each player is awarded a predetermined number of betting tokens, and each player is further awarded a chalk board organization, each chalk board organization including a chalk board surface, a chalk writing implement, and a chalk eraser, and wherein a series of six arrays of contrasting colored wagering tickets are provided to award each player upon each player wagering utilizing the chip tokens, and a game blackboard defined by a central writing surface, wherein the central writing surface includes six columns directed downwardly to a medial portion of the writing surface, with each column corresponding to the six tokens for arbitrarily writing down the betting odds of each token and for indicating the wagering awarded each token, and an information space underlying the columns for indication of wagering totals effected by the players.

* * * * *